US005136934A

United States Patent [19]

Darby, Jr.

[11] Patent Number: 5,136,934

[45] Date of Patent: Aug. 11, 1992

[54] COMPACTOR FOR AUTOMOTIVE OIL FILTER WITH SUPPORT FRAME

[76] Inventor: Barney D. Darby, Jr., P.O. Box 73, Anderson, S.C. 29622

[21] Appl. No.: 678,237

[22] Filed: Apr. 1, 1991

[51] Int. Cl.[5] ..... B30B 9/02

[52] U.S. Cl. ..... 100/125; 100/131; 100/245; 100/269 B; 100/299; 100/902

[58] Field of Search ..... 100/102, 103, 125, 131, 100/240, 245, 246, 269 B, 299, 902, 214; 248/544, 664

[56] References Cited

U.S. PATENT DOCUMENTS

| | | | |
|---|---|---|---|
| 533,558 | 2/1895 | Roberts | 100/102 X |
| 961,525 | 6/1910 | Baltzley | 248/664 X |
| 3,337,166 | 8/1967 | Hansen | 248/664 |
| 3,835,768 | 9/1974 | Kidson | 100/902 X |
| 4,126,160 | 11/1978 | Gurtler | 100/902 X |
| 4,334,469 | 6/1982 | Tanner et al. | 100/902 X |
| 4,771,686 | 9/1988 | Triantos, Jr. | 100/131 X |
| 4,927,085 | 5/1990 | Oberg | 100/131 X |
| 5,060,564 | 10/1991 | Buford et al. | 100/902 X |

*Primary Examiner*—Harvey C. Hornsby
*Assistant Examiner*—Stephen F. Gerrity
*Attorney, Agent, or Firm*—Bailey & Hardaway

[57] ABSTRACT

A compactor for automotive oil filters is illustrated wherein an upright hydraulic cylinder D is its lower end upon a vertical housing A open on one side for reception of an oil filter and for removal thereof after compaction with a central passageway F in a lower support C for relieving air pressure generated during compression and compaction.

4 Claims, 2 Drawing Sheets

COMPACTOR FOR AUTOMOTIVE OIL FILTER WITH SUPPORT FRAME

BACKGROUND OF THE INVENTION

This invention relates to a compactor for automotive oil filters which is readily accessible for insertion and removal of automotive oil filters for compaction.

Automotive oil filters have been required in many instances to be treated as hazardous waste material such as must be sealed in drums for disposal. This process of storing the automotive oil filters and the like in drums is expensive, and the excessive bulk thereof compounds the problem of disposal. It has been recognized that it is desirable to compact the oil filters prior to their insertion in drums preparatory to disposal. A number of efforts have been made to provide compactors which are effective and efficient so as to be put into practical use in a variety of locations. Generally, however, such compactors utilize expensive pumps for operating the hydraulic mechanism and access doors must be opened for insertion and removal of the oil filters. U.S. Pat. No. 4,771,686 illustrates the use of a closed receptacle containing an oil can, oil filters, and the like during compaction. U.S. Pat. No. 4,927,085 illustrates an apparatus for recycling oil filters wherein a compartment has a door which must be opened for insertion and removal of the oil filters with elaborate provision for placement of the compacted canister and for recovery of oil retained within the oil filters.

Accordingly, it is an important object of the present invention to provide a compaction apparatus for automotive oil filters and the like wherein a housing has a readily accessible opening on at least one side for ready reception of the oil filters for compaction and removal.

Another important object of the invention is the provision of an economical compaction device having an upright framework for positioning a vertical housing carrying a ram or cylinder which is mounted at its lower end upon the upper portion of the housing for providing a low profile economical structure.

Another important object of the invention is the provision of a compactor for automotive oil filters and the like wherein the filters are readily receivable for compaction with collection of oil squeezed from the filters during compaction without rupture of the filter container as may result in spraying the operator with oil.

SUMMARY OF THE INVENTION

It has been found that a compactor for automotive oil filters facilitating storage in drums for disposal as waste may be provided in a low profile inexpensive structure wherein a vertical housing is provided for mounting a cylinder on top thereof while the housing and related parts are carried upon an upright frame collapsible for reception within a tray for receiving oil squeezed from the filter during compaction. The housing is permanently open and sized for ready reception and removal of the oil filters. A centrally disposed passageway is provided in a lower portion of the housing above the tray for removal of oil into the tray and relieves air pressure generated within a casing of the oil filter during compaction so as to avoid possible injury to an operator as may result from rupture of the container or canister during compaction.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate a compactor for automotive oil filters including a vertical housing A having an open front sized for insertion and reception of an automotive oil filter within the housing. Opposed support members B and C are carried at upper and lower respective ends of the vertical housing A forming a vertical housing assembly. A hydraulic cylinder D is fixed adjacent its lower end to the upper support member B. The cylinder D is carried above the upper support member and has a piston rod extending downwardly through the upper support member. A compactor plate is carried by a lower end of the piston rod. A pump E is provided for actuating the hydraulic cylinder for lowering the compactor plate for compression and compaction of an automotive oil filter. The automotive oil filter is supported by the lower support member C during compression and compaction. A central passageway F extends downwardly through the lower support member relieving air pressure generated in the automotive oil filters as a result of compression and compaction. A base tray G carries the housing receiving oil compressed from an automotive oil filter as a result of the compression and compaction. Thus, a low profile compactor may be economically constructed for ready access for insertion of an automotive oil filter into the housing and operated while retaining oil compressed from an automotive oil filter during compaction.

Figure 1:
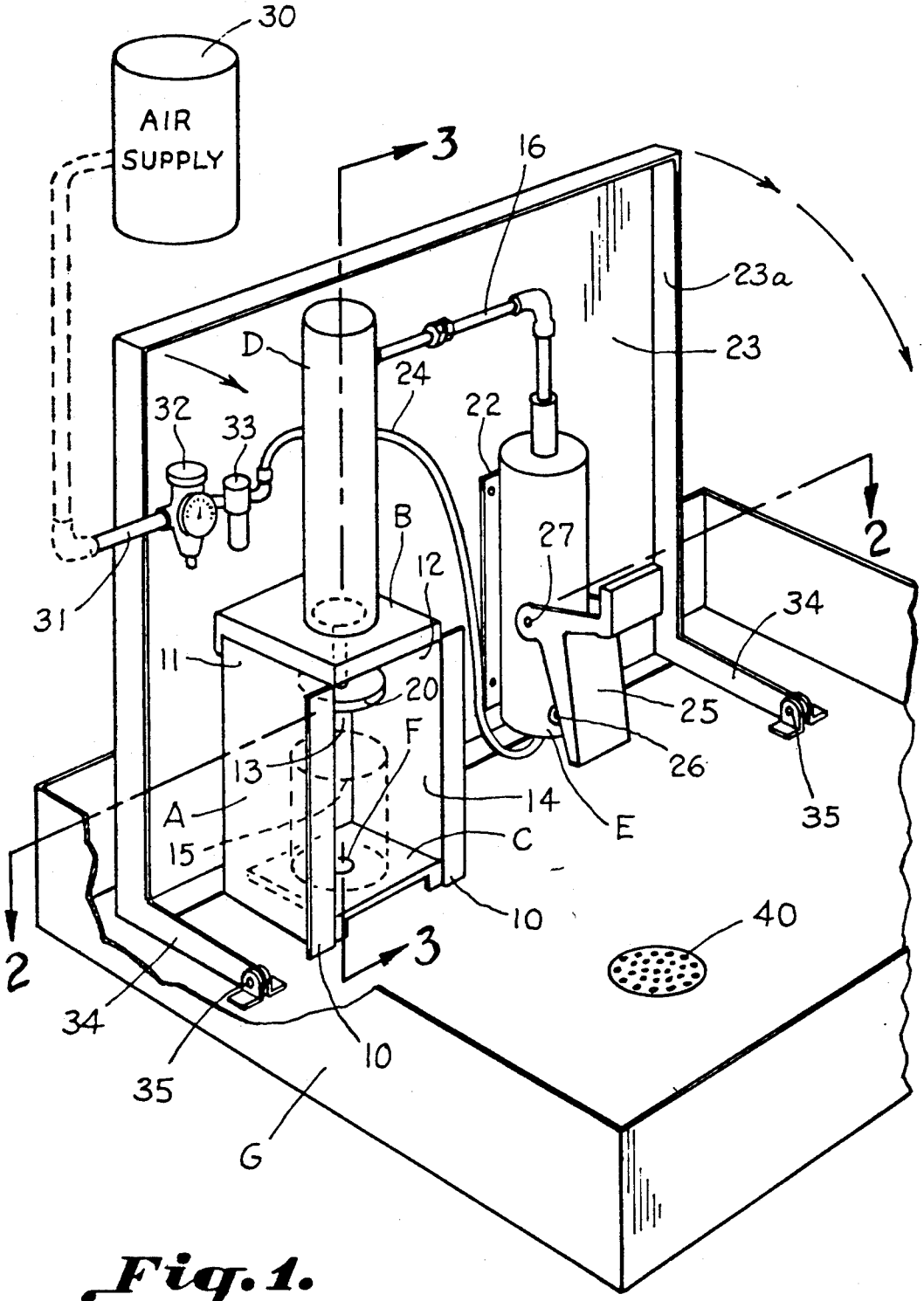
FIG. 1 is a perspective view illustrating a compactor constructed in accordance with the invention wherein an upright housing is illustrated as carrying an upright cylinder on top with related parts.
Figure 2:
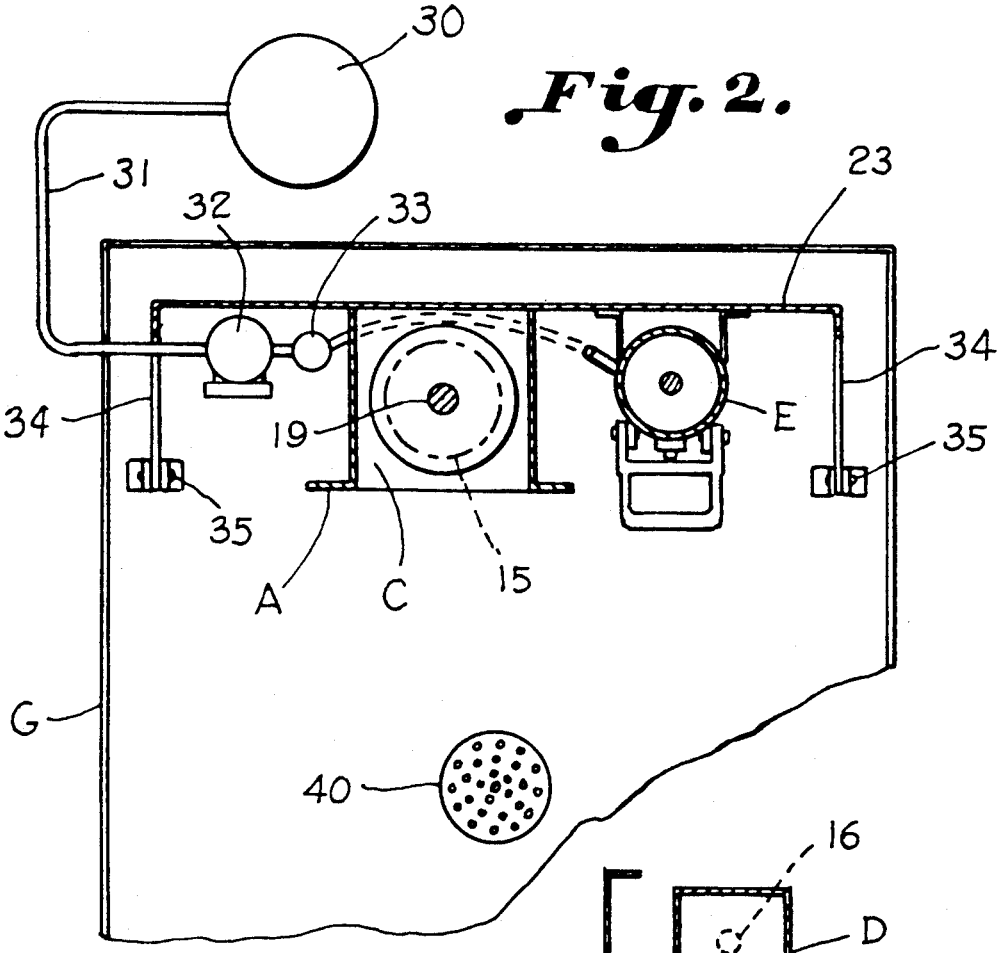
FIG. 2 is a sectional elevation taken on the line 2—2 in FIG. 1.

Referring especially to FIG. 1, a vertical housing A is illustrated as utilizing legs 10 which carry opposed side members 11 and 12 joined by a back side 13. Thus, the housing is substantially closed except at the front. This provides an open front 14 upon the housing A which is sized for reception of an oil filter illustrated at 15 in broken lines in FIGS. 1, 2 and 3. The oil filter is illustrated in inverted position during compaction so that the opening is carried at the end of the filter adjacent the lower portion of the housing. The vertical housing A carries an upper support member B which is supported by the legs 10 at each corner thereof. A lower support member C is carried at the lower portion of the housing A and is supported by the legs above the tray which is provided for the reception of oil removed from the filters as a result of the compaction operation.

Figure 3:
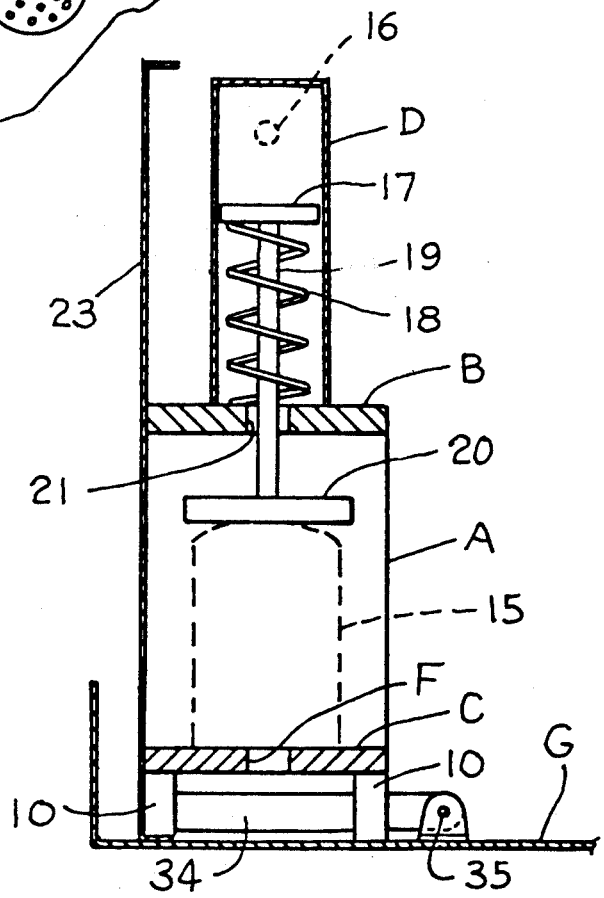
FIG. 3 is a transverse sectional elevation illustrating the housing and cylinder taken on the line 3—3 in FIG. 1.

The cylinder or ram D is operated by hydraulic fluid which enters through the line 16 adjacent the top thereof to operate the piston 17 which is upwardly biased by a spring 18 carried upon the piston rod 19 between the piston and in a lower end of the cylinder which is carried by the support member B (FIG. 3).

A lower end of the piston rod 19 which extends through an opening 21 in the support member B carries a compaction plate 20 of suitable size to extend across the oil filters.

A suitable air pump E is provided for applying pressure to the hydraulic fluid which enters through the line 16 into the cylinder D. The air operated hydraulic pump is provided together with controls therefore by American Forge & Foundry, 10 Corporate Circle, P.O. Box 519, Guilderland, NY 12084. The air pump and assocated mechanism is mounted upon a bracket 22 carried by the upright frame member 23. The air pump E is provided with a source of air under pressure through the line 24. A pivoted treadle 25 is depressible at its lower end in FIG. 1 to operate a plunger 26 to aid in the control operation of the pump. A valve is operated as at 27 for controlling release of hydraulic fluid upon pivoting of the treadle in the opposite direction for permitting the compaction plate to rise as a result of the upward force of the spring 18.

It will be observed that the line 24 is provided with a source of compressed air from an air supply 30 as often provided in a variety of service stations through the line 31 provided with a gage 32 and lubricator 33.

It will be noted that the upright frame has sides 23*a* providing rigidity and protection for the various components. The frame 23 has forwardly projecting legs 34 which are pivotally carried as at 35 permitting the support frame 23 to be pivoted downwardly into the tray G for facilitating shipment and storage. The tray receives oil from the passageway F in the lower support member C carried in a central portion thereof. A drain is illustrated at 40 within the tray G permitting oil which has been collected to be suitably drained from the tray into the desirable container.

It is thus seen that a compactor for automotive oil filters which is readily accessible for insertion and removal of automotive oil filters without opening a door or other access opening and which is provided with an air relieving passageway to avoid rupture of the automotive oil filter as a result of pressure generated during compaction as may result in the spraying of oil contained within the filter upon the operation of the compactor.

The vertical housing assembly, including the vertical housing A and support members B and C, provide support for forces generated during the compaction process, retain alignment of the operating components so as to provide uniform compaction, and provide a compact, light weight machine requiring minimum floor space.

While a preferred embodiment of the invention has been described using specific terms, such description is for illustrative purposes only, and it is to be understood that changes and variations may be made without departing from the spirit or scope of the following claims.

What is claimed is:

1. A compactor for automotive oil filters comprising:

a vertical housing having an open front sized for insertion and reception of an automotive oil filter within said housing;

opposed support members carried at upper and lower opposed support members carried at upper and lower respective ends of said vertical housing;

a hydraulic cylinder fixed adjacent its lower end to said upper support member;

said cylinder being carried above said upper support member and having a piston rod extending downwardly through said upper support member;

a compactor plate carried by a lower end of said piston rod;

a pump carried laterally of said vertical housing connected to said hydraulic cylinder actuating said hydraulic cylinder for lowering said compactor plate for compression and compaction of said automotive oil filter;

said automotive oil filter being supported by said lower support member during compression and compaction;

a central passageway extending downwardly through said lower support member relieving air pressure generated in said automotive oil filters as a result of compression and compaction;

an upright frame support carrying said vertical housing, said cylinder and said pump a base tray carrying said upright frame support and receiving oil compressed from an automotive oil filter as a result of said compression and compaction; and said base tray carrying said upright frame support for reception in said base tray so as to conserve space and provide support facilitating shipment and storage;

whereby a low profile compactor of minimal height may be economically constructed for ready access for insertion of said automotive oil filter into said housing and operated while retaining oil compressed from an automotive oil filter during compaction.

2. The structure set forth in claim 1 wherein said pump is an air pump.

3. The structure set forth in claim 1 wherein said vertical housing is substantially closed on three sides opposite said open front during compaction.

4. The structure set forth in claim 1 wherein said upright frame support is pivotally connected to and within said base tray.

* * * * *